US009146074B1

(12) United States Patent
McCarthy

(10) Patent No.: US 9,146,074 B1
(45) Date of Patent: Sep. 29, 2015

(54) REAR SLING MOUNT

(71) Applicant: Kevin McCarthy, Bend, OR (US)

(72) Inventor: Kevin McCarthy, Bend, OR (US)

(73) Assignee: Sly Tactical L.L.C., Bend, OR (US)

( * ) Notice: Subject to any disclaimer, the term of this patent is extended or adjusted under 35 U.S.C. 154(b) by 0 days.

(21) Appl. No.: 14/478,847

(22) Filed: Sep. 5, 2014

Related U.S. Application Data

(60) Provisional application No. 61/995,465, filed on Apr. 9, 2014.

(51) Int. Cl.
*F41C 23/02* (2006.01)

(52) U.S. Cl.
CPC ..... *F41C 23/02* (2013.01)

(58) Field of Classification Search
CPC ..... F41C 33/002
USPC ..... 42/85; 224/150
See application file for complete search history.

(56) References Cited

U.S. PATENT DOCUMENTS

| | | | | |
|---|---|---|---|---|
| 6,520,390 | B2 * | 2/2003 | Verdugo et al. | 224/150 |
| 6,598,330 | B2 * | 7/2003 | Garrett et al. | 42/85 |
| 7,562,481 | B2 | 7/2009 | Esch | |
| 7,814,697 | B2 | 10/2010 | Esch | |
| 8,312,662 | B2 | 11/2012 | Rogers et al. | |
| 8,596,504 | B2 | 12/2013 | Haley, Sr. et al. | |
| 8,640,373 | B2 * | 2/2014 | Burt | 42/85 |
| 2005/0034347 | A1 * | 2/2005 | Verdugo | 42/85 |
| 2010/0162609 | A1 * | 7/2010 | Rogers et al. | 42/85 |
| 2010/0287808 | A1 * | 11/2010 | King | 42/85 |
| 2011/0138671 | A1 * | 6/2011 | Rogers et al. | 42/85 |
| 2011/0239512 | A1 * | 10/2011 | Kleven | 42/85 |

* cited by examiner

*Primary Examiner* — Reginald Tillman, Jr.
(74) *Attorney, Agent, or Firm* — St. Onge Steward Johnston & Reens LLC

(57) ABSTRACT

A sling mount or attachment for the rear portion of a firearm is provided. The sling mount includes a cap and a base, removably coupled by screws around a buffer tube of a firearm. The sling mount further includes a connection loop positioned below the opening created by coupling the cap to the base. In some embodiments, the connection loop extends in a vertical plane parallel to the longitudinal axis of the buffer tube, and is centrally located underneath it. A user may attach a sling to the connection loop via a snaphook in order to accomplish a one-point or two-point sling design.

19 Claims, 12 Drawing Sheets

REAR SLING MOUNT

FIELD OF THE INVENTION

The present invention relates to the field of attaching slings to weapons, and more particularly, relates to sling mounts used to secure slings to firearms.

BACKGROUND OF THE INVENTION

The general use of sling mounts to attach slings to a firearm is fairly well known. Slings provide a way for users to more easily carry and retain a firearm in an active environment. When a user becomes involved in active conflict, particularly in urban conflicts, it is beneficial for the user to incorporate a sling attached to a sling mount in order to provide additional steadiness for accuracy purposes, or to provide an easy way for the user to free his or her hands without having to put the firearm down or otherwise unsecure the firearm. When not involved in active conflict, a sling allows the weapon to be comfortably secured to the user's side, back, or chest. Furthermore, a sling allows a user to quickly access the firearm from the secured position should the need arise.

Slings are most commonly attached to a firearm, such as a rifle or a shotgun, by either single-point, two-point, or three-point designs. The number of points in each design refers to the number of points at which the sling is anchored to the weapon. For example, a single-point sling is generally attached near the rifle's midpoint, and a two-point sling is generally attached once near the front end of the firearm and once near the buttstock of the firearm. A user may prefer one design over the other in order to obtain greater freedom of firearm movement, or to provide greater firearm security.

A sling is attached to a particular point by securing it to an attachment or mount installed at various places on the firearm. The receiver end plate of a rifle or shotgun is a common location for a sling attachment or mount to be located because it resides just behind the pistol grip and thus will not impede a user's ability to quickly fire the firearm. Current designs of clamp on sling mounts with loops for snaphook type attachments that incorporate loops on either the right or left side or both, such as that described in U.S. Pat. No. 8,312,662 to Rogers et al. These loops are bulky and tend to get caught up on gear worn by the user or interfere with manipulation of the charging handle or safety. Although most users will favor either a left or right handed configuration, certain conflict environments, such as aiming around a corner, demand that a user change orientation. This can prove difficult with sling mounts that provide attachment points on the side of the firearm. Therefore, there is a need for a sling mount with a true ambidextrous configuration.

U.S. Pat. No. 8,596,504 to Haley, Sr. et al. discloses an ambidextrous configuration of a sling mount having a horizontal bar to which a connecting ring slides back and forth as the user moves the sling from a left-handed to a right-handed orientation. Haley, Sr. et al. allows for a greater range of motion, but comes with several drawbacks. Since the sling must slide across the horizontal bar, if the sling strap catches on a user's gear or is otherwise inhibited, the orientation may not change or could cause the user to have difficulty operating his or her firearm. It is desirable to minimize the time required and any difficulty encountered when switching orientations because of the nature of using firearms in active conflict environments. Another drawback is that installation of this variety requires disassembly of the firearm. Many law enforcement agencies and the military do not allow disassembly of the existing castlenut or receiver end plate in order to install sling mounts such as those disclosed by Haley, Sr. et al. Lastly, since the connecting ring is not fixed, movement of the sling generates noise, which may be undesirable in a stealth operation.

Another means of providing an ambidextrous configuration is to install a swivel connector piece into the lower portion of a sling mount as shown by U.S. Pat. Nos. 7,562,481 and 7,814,697 to Esch. In these patents, the swivel connector piece includes a ring coupled to the swivel body. As the user moves from one handed orientation to the other, the swivel piece twists to allow the sling to change orientations. However, this configuration has the drawback of causing the sling to frequently become twisted. These designs also require three separate pieces (top clamp member, bottom clamp member, swivel mount), and the addition of more pieces increases the difficulty of installation for the user and increases the maintenance required.

What is desired, therefore, is a sling mount for a firearm that provides a true ambidextrous configuration. What is also desired is a sling mount that may be installed with as few pieces as possible without disassembling the firearm. What is further desired is a sling mount that minimizes excess noise and prevents twisting of the sling.

SUMMARY OF THE INVENTION

In order to overcome the deficiencies of the prior art and to achieve the objects and advantages listed, the invention comprises a sling mount comprising a base member comprising a surface for engaging a buffer tube of a weapon, a cap member removably coupled to the base member for securing the base member to the buffer tube of the weapon, wherein a portion of the base member comprises a connection loop for attaching a snaphook, wherein the connection loop is located on the underside of the base member such that, when the base member is secured to the buffer tube, the connection loop is positioned under the buffer tube.

In certain advantageous embodiments, the connection loop extends along a vertical plane substantially parallel to the longitudinal axis of the buffer tube. In some of these embodiments, the connection loop includes a first end and a second end, the first end is located on the underside of the base member adjacent the buffer tube, and the second end is located on the underside of the base member adjacent to a receiver end plate of the weapon.

In certain embodiments, the connection loop is located at an approximately central position of the underside of the base member. In some cases, the connection loop is integrally formed with the base member, and in certain cases, the connection loop extends in an arc.

In certain advantageous embodiments, a plurality of tabs extend longitudinally from the base member, the tabs configured to extend over an outer surface of a receiver end plate of the weapon for preventing movement of the sling mount.

In some embodiments, the cap member further comprises a plurality of threaded bosses oriented in a vertical plane perpendicular to a longitudinal axis of the buffer tube, and wherein the base member further comprises a plurality of recessed bosses oriented in a vertical plane perpendicular to a longitudinal axis of the buffer tube, such that, when the cap member is coupled to the base member, the threaded bosses of the cap member align with the recessed bosses of the base member. In certain of these embodiments, the cap member is coupled to the base member via screws passed through the recessed bosses into the threaded bosses, and in some cases, the screws are about 5/32" inches.

In certain embodiments, when the sling mount is coupled to the buffer tube, the cap member is positioned adjacent to a castle nut of the weapon and the base member is positioned adjacent to a receiver end plate of the weapon.

In some embodiments, the invention further includes a sling removably connected to the connection loop of the base member. In some cases, the sling comprises a snaphook by which the sling is connected to the base member.

In some embodiments, the invention further includes a weapon comprising a buffer tube and the sling mount coupled to the buffer tube. In some cases, the weapon is a rifle, and in other cases, the weapon is a shotgun.

DETAILED DESCRIPTION OF THE INVENTION

Figure 1:
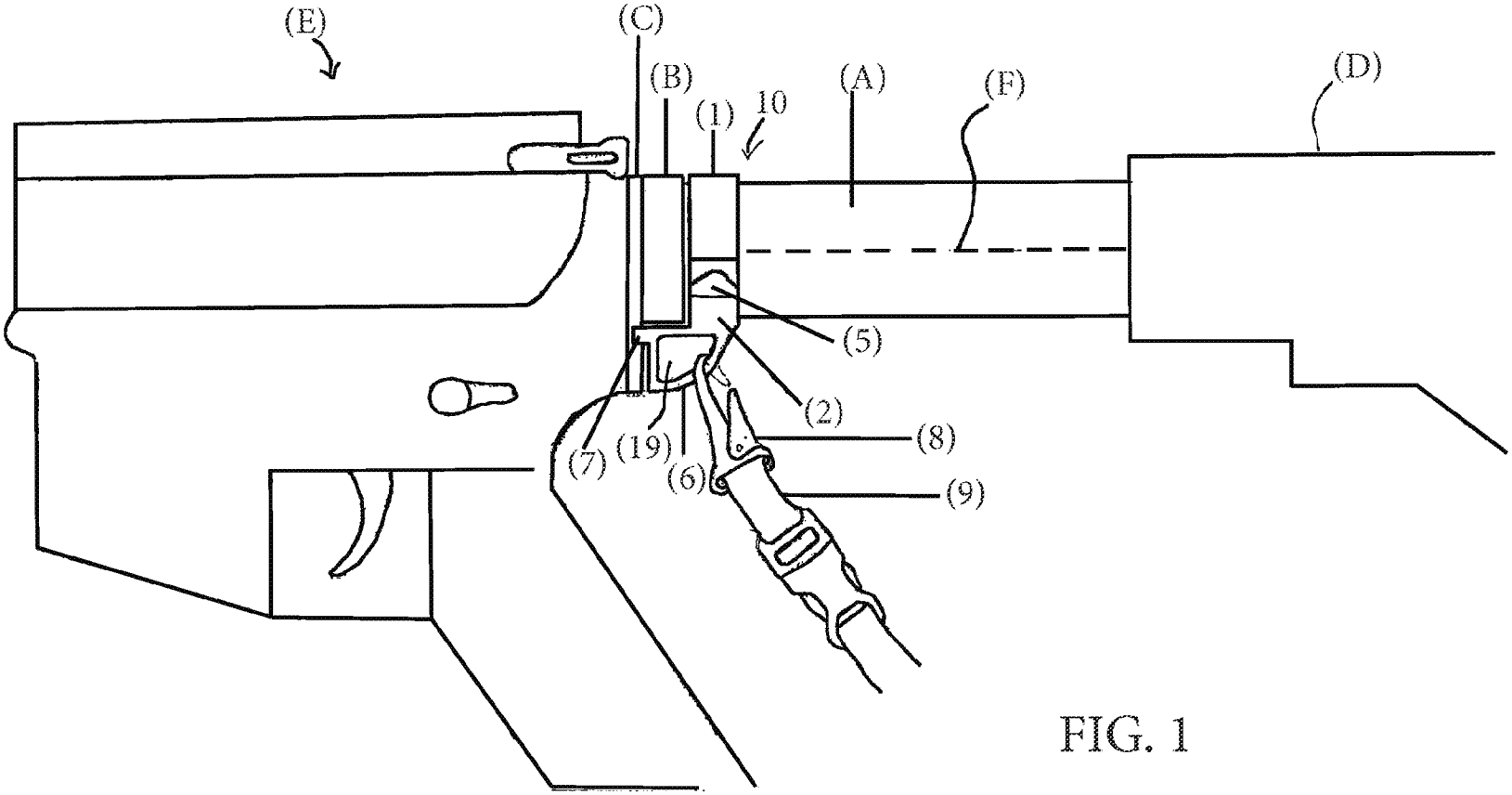
FIG. 1 is a side view of a sling mount assembled on a rifle buttstock tube in accordance with the present disclosure.

The basic components of one embodiment of a rear sling mount in accordance with the invention are illustrated in FIG. 1. As used in the description, the terms "top," "bottom," "above," "below," "over," "under," "above," "beneath," "on top," "underneath," "up," "down," "upper," "lower," "front," "rear," "back," "forward" and "backward" refer to the objects referenced when in the orientation illustrated in the drawings, which orientation is not necessary for achieving the objects of the invention.

As shown in FIG. 1, a sling mount (10) for a rifle is illustrated, including a cap (1) and a base (2) coupled to the cap (1) around a buffer tube (A). It is to be understood that while the sling mount (10) is described in the context of attaching a sling mount to a rifle (E), one or more features of the present disclosure can be adapted for use with weapons having a similar configuration. The present disclosure is not to be limited to the representative embodiment illustrated and described herein. For example, the sling mount (10) can be installed on firearms with Mil-Spec buffer tubes such as M-16, AR-15, or M4 rifles, or shotguns with similar buffer tubes. In some embodiments, the sling mount (10) is designed for commercial or other buffer tubes.

The sling mount (10) is composed of a suitable material, such as CNC machined 6061 T6 aluminum and hard anodized per Mil-A-8625 Type III Class 2. In advantageous embodiments, the material chosen results in a sling mount (10) that weighs about ½ ounce. Other materials resulting in different sling mount (10) weights, including other metals or plastics, may be selected depending on the particular firearm or the particular application.

An advantage of the present invention is that the sling mount is coupled around the firearm without requiring any firearm disassembly. Users may not know how to properly disassemble their firearm, may not wish to take the time to break the firearm down or remove the buttstock (D), or may be prohibited from disassembling the firearm, as is frequently the case in law enforcement agencies or in the military. The cap (1) is secured around an upper portion of the buffer tube (A) adjacent to a castlenut (B). The base (2) is secured around a lower portion of the buffer tube (A) adjacent to a receiver endplate (C). This area is preferable for positioning the sling mount (10) because the firearm's diameter is small between the castlenut (B) and a buttstock (D). When using a one-point or two-point sling, it is preferable to have the sling connected behind the castlenut (B) and receiver end plate (C). Connecting to this area decreases the chance of hindering the user's ability to maneuver the weapon when the user switches from an inactive mode where the firearm is at the user's side, front, or back, to an active mode where the firearm is readied to fire. If the sling is connected in a one-point configuration on an upper portion of the firearm or near the front of the firearm, the sling strap can potentially obstruct the user's view or make it more difficult to aim, as well as interfere with manipulation of the charging handle.

Once the cap (1) is coupled to the base (2) around the buffer tube (A), a user connects a sling strap (9) via a snaphook (8) to the base (2). The snaphook (8) hooks onto a connection loop (6) that is integrated into the base (2), as described below with reference to FIGS. 2-4. Preferably, the snaphook (8) is an HK style spring snaphook, but any type of snaphook that suitably couples the sling to the sling mount (10) is acceptable.

Figure 2:
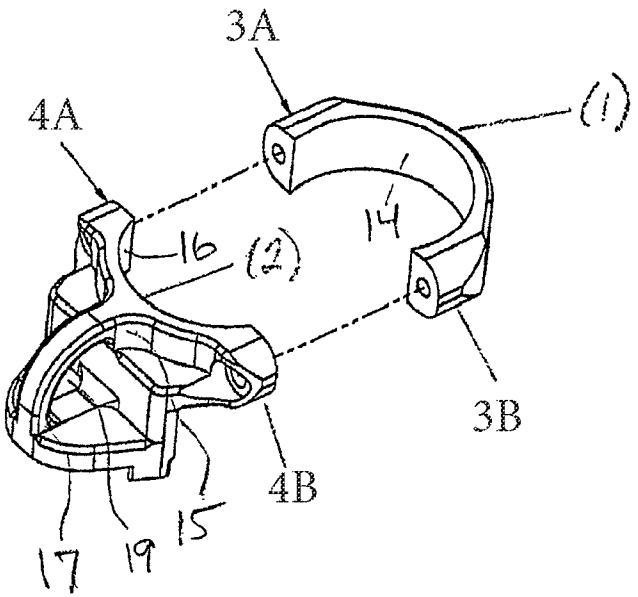
FIG. 2 is an exploded perspective view of the sling mount of FIG. 1, illustrating the cap member and the base member.
Figure 3:
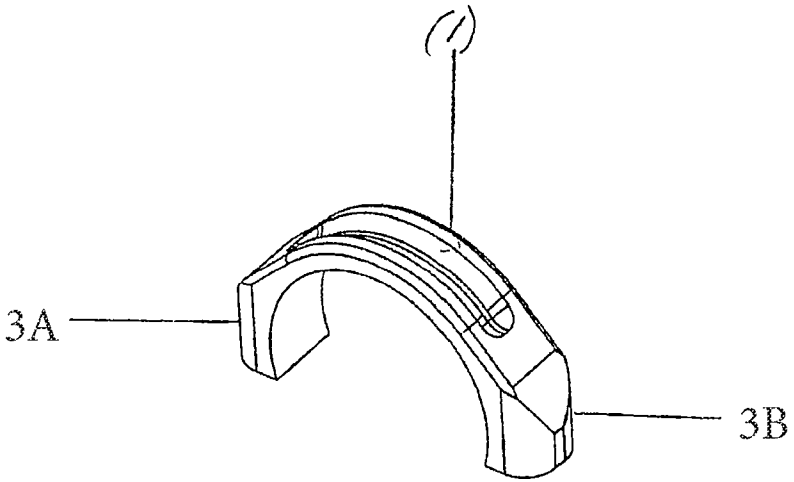
FIG. 3 is a perspective view of the cap member of FIG. 2.
Figure 4:
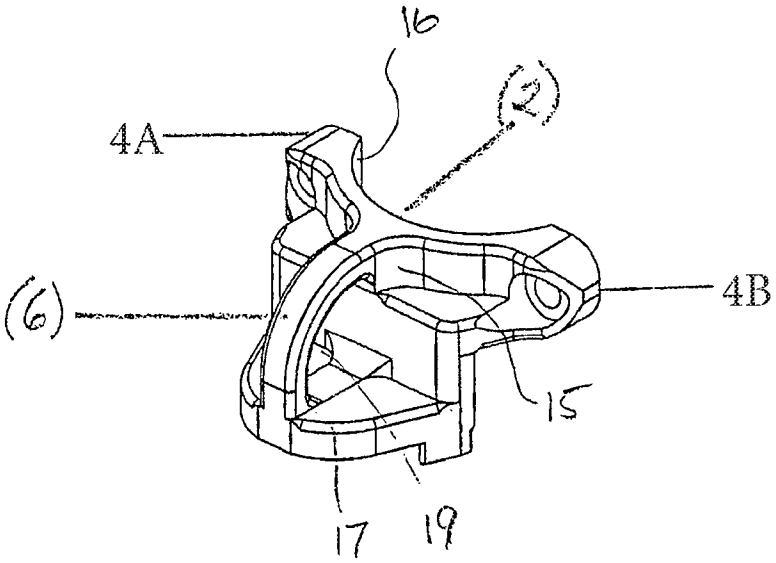
FIG. 4 is a perspective view of the base member of FIG. 2

As shown in FIGS. 2-4, the cap (1) and the base (2) are illustrated in a non-coupled orientation. The cap (1) includes an arcuate-shaped surface (14) for engaging the buffer tube (A), a first threaded boss (3A) and a second threaded boss (3B). The base (2) includes an arcuate-shaped surface (16) for engaging the buffer tube (A), a first recessed boss (4A), a second recessed boss (4B), and a connection loop (6). When coupling the cap (1) to the base (2), the first threaded boss (3A) should line up with the first recessed boss (4A) and the second threaded boss (3B) should line up with the second recessed boss (4B), such that the arcuate-shaped surfaces (14, 16) of the cap (1) and the base (2) meet and form a circumferential opening. When assembling the sling mount (10), the cap (1) is coupled to the base (2) around the buffer tube (A) by passing two screws (5) as shown in FIG. 1 through the first and second recessed bosses (4A, 4B) into the first and second threaded bosses (3A, 3B). The screws (5) may be constructed of a suitable material, such as black oxide coated stainless steel, and may be about 6/32 inches, but other materials or dimensions may also be used depending on particular applications. Any screw or fastener that sufficiently couples the cap (1) to the base (2) may be acceptable.

In one advantageous embodiment, the surfaces (14, 16) are sized to fit a Mil-Spec buttstock/buffer tube having a circumference of approximately 1.143 inches. In another advantageous embodiment, the surfaces (14, 16) are sized to fit a commercial buttstock/buffer tube with a circumference of approximately 1.173 inches. The cap (1) and the base (2) do not necessarily require arcuate-shaped surfaces, as the shape of the opening created by coupling the cap (1) and the base (2)

may be adapted to fit around differently shaped firearms. In an advantageous embodiment, the sling mount (10) is coupled around a cylindrical Mill-spec buffer tube. In other embodiments, the sling mount (10) includes a cap (1) and a base (2) that have differently shaped surfaces to accommodate firearms with differently shaped buffer tubes or buttstocks. For example, the firearm may not have a buffer tube and instead has a rectangular buttstock that the cap and base surfaces (14, 16) can be adapted to engage such that the mount (10) can be coupled thereto.

Figure 5:
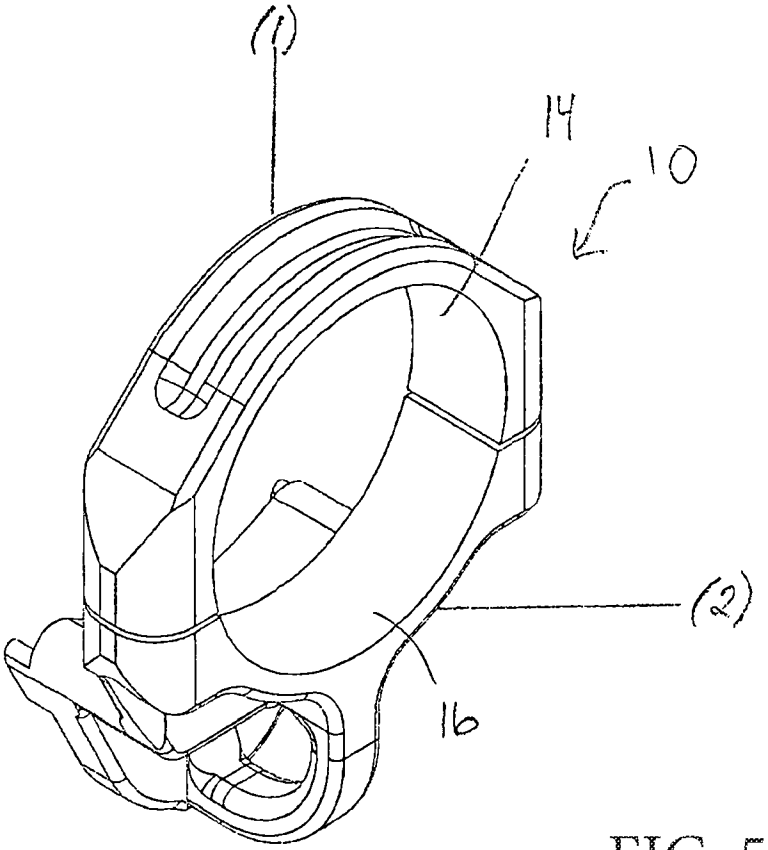
FIG. 5 is a perspective view of the assembled sling mount of FIG. 1.
Figure 6:
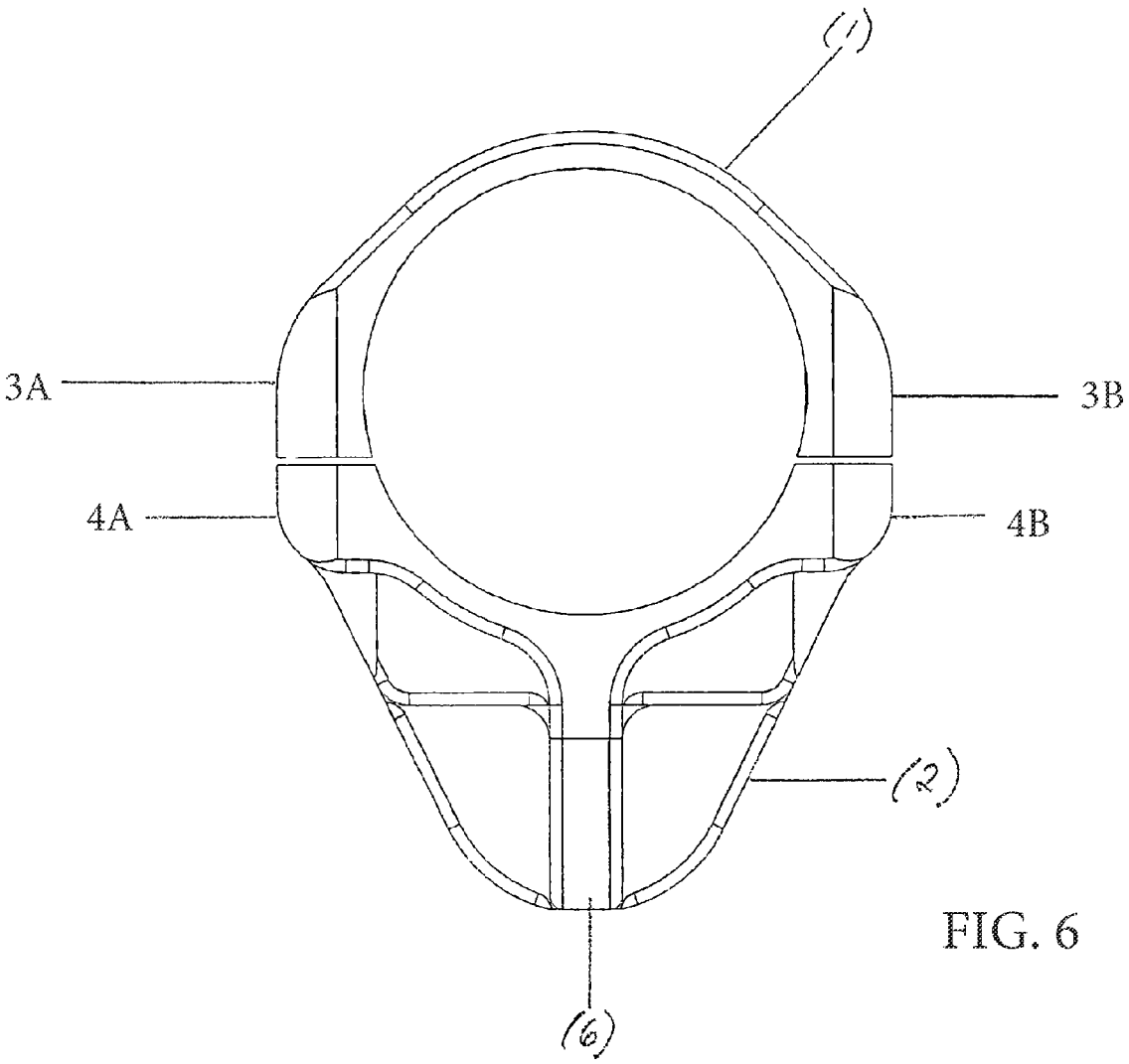
FIG. 6 is a rear view of the assembled sling mount of FIG. 1.
Figure 7:
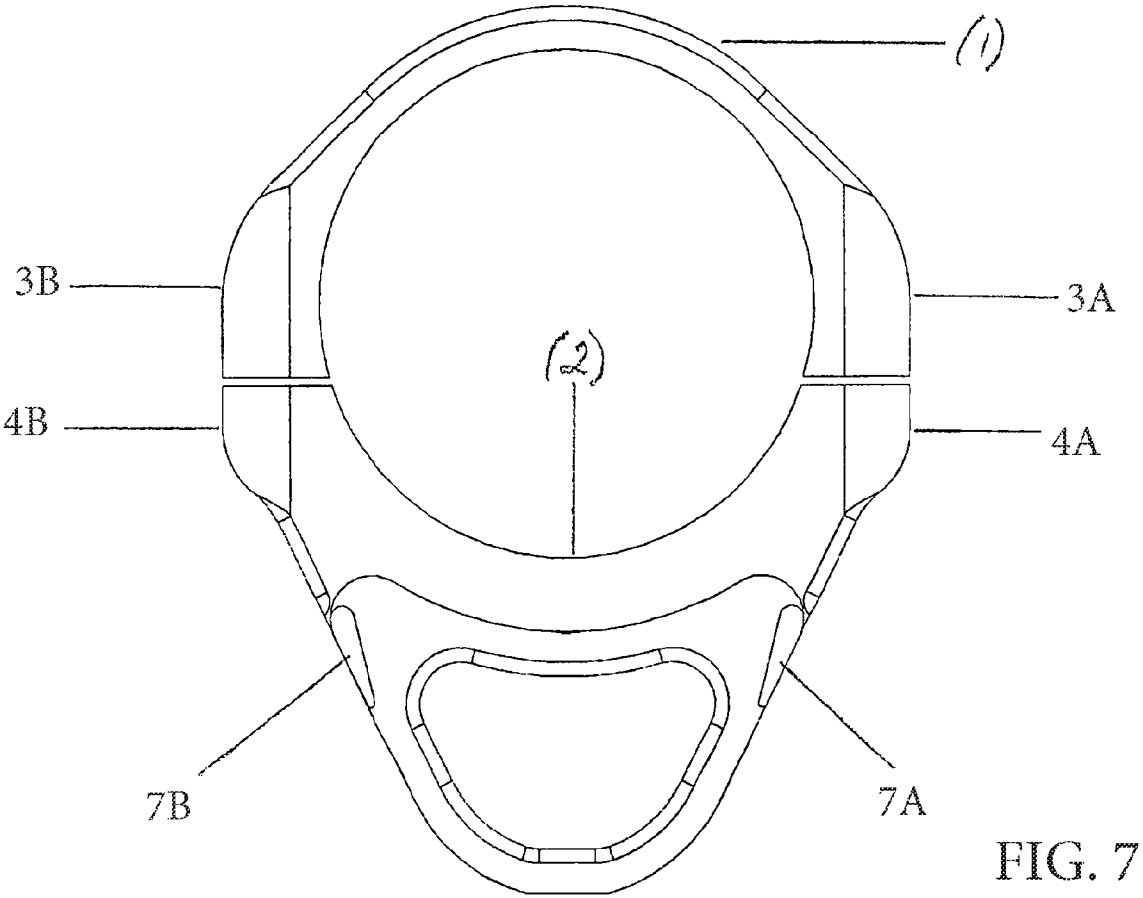
FIG. 7 is a front view of the assembled sling mount of FIG. 1.
Figure 8:
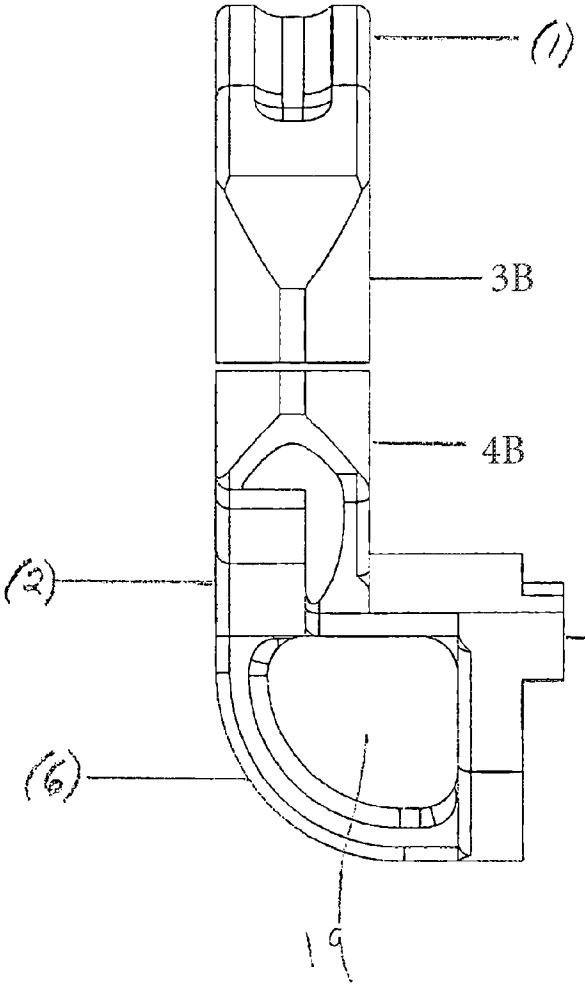
FIG. 8 is a right side view of the assembled sling mount of FIG. 1.
Figure 9:
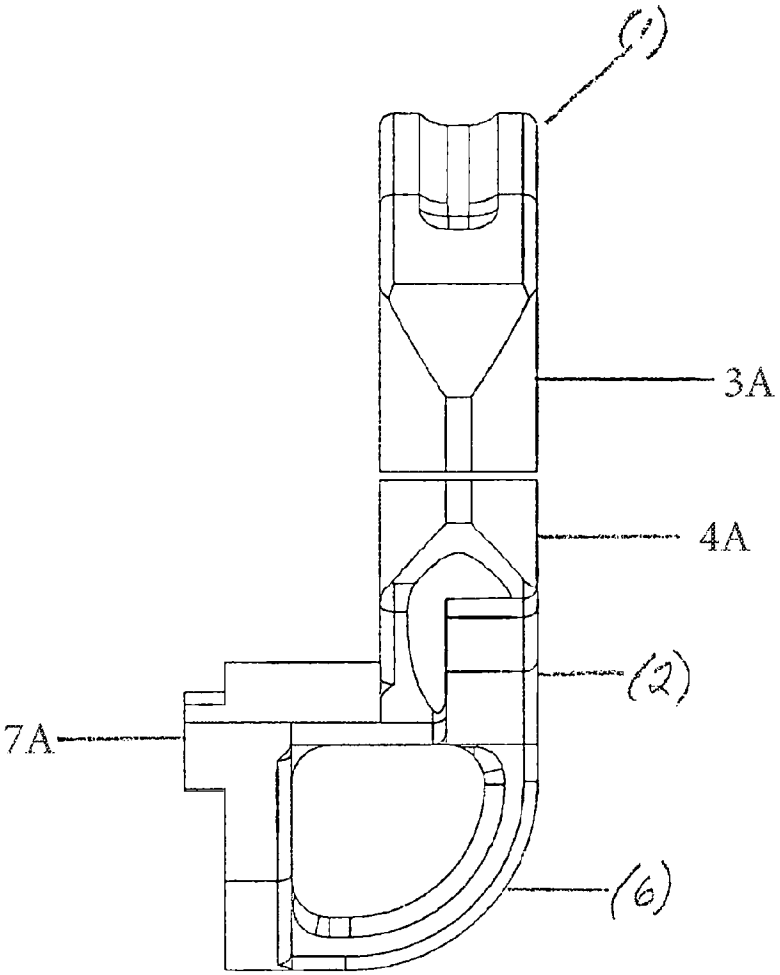
FIG. 9 is a left side view of the assembled sling mount of FIG. 1.

In advantageous embodiments, the connection loop (6) extends in a plane vertical to the longitudinal axis (F) of the buffer tube (A), as shown in FIG. 1. Referring also to FIG. 4, the loop (6) extends from an underside base portion (15) to a rear base portion (17) adjacent to the receiver end plate (C). The underside base portion (15) is directed oppositely to the surface (16), shown more clearly in FIG. 5, which is oriented toward the opening created by the cap (1) and base (2) in a coupled state. In an advantageous embodiment, the connection loop (6) is located centrally underneath the base (2). A central, vertical connection loop (6) provides the user with a particularly balanced ambidextrous configuration. The connection loop (6) contains an opening (19) through which a cord, strap or connector of a harness is attached in order to secure the harness to the sling mount (10). Preferably, a sling strap (9) is attached to the connection loop (6) via a snaphook (8). Due to the loop's (6) central location and vertical orientation, the user can quickly switch firearm orientations from left-handed to right-handed, while minimizing the hindrance of the sling strap and the sling strap's proclivity to tangle on gear the user is wearing. In other embodiments, the connection loop (6) may be slightly off-centered in order to accommodate users who prefer a dominant left or right-handed configuration. At least a portion of the connection loop (6) is arcuate-shaped. However, any connection loop shape that provides a substantially ambidextrous configuration may be used, such as a connection loop having a right angle shape or having a non-angled direct connection loop between the underside portion (15) and the rear base portion (17) adjacent to the receiver end plate (C). In particularly advantageous embodiments, the loop (6) is integrally formed with the base (2).

Figure 10:
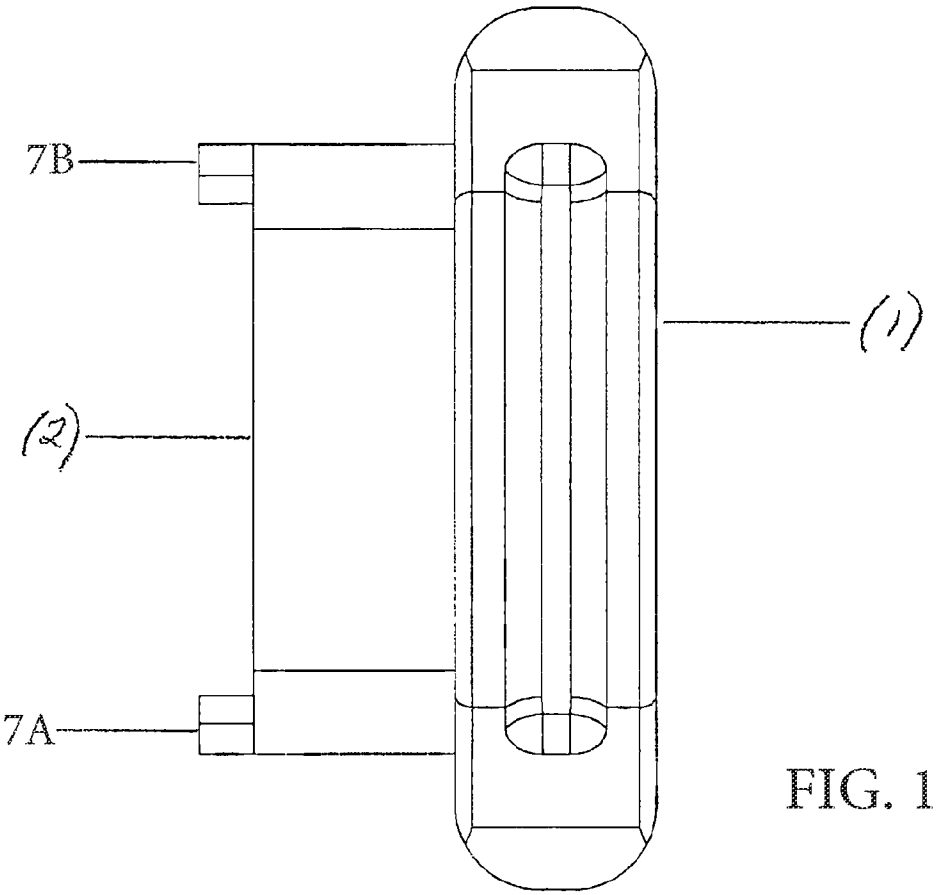
FIG. 10 is a top view of the assembled sling mount of FIG. 1.
Figure 11:
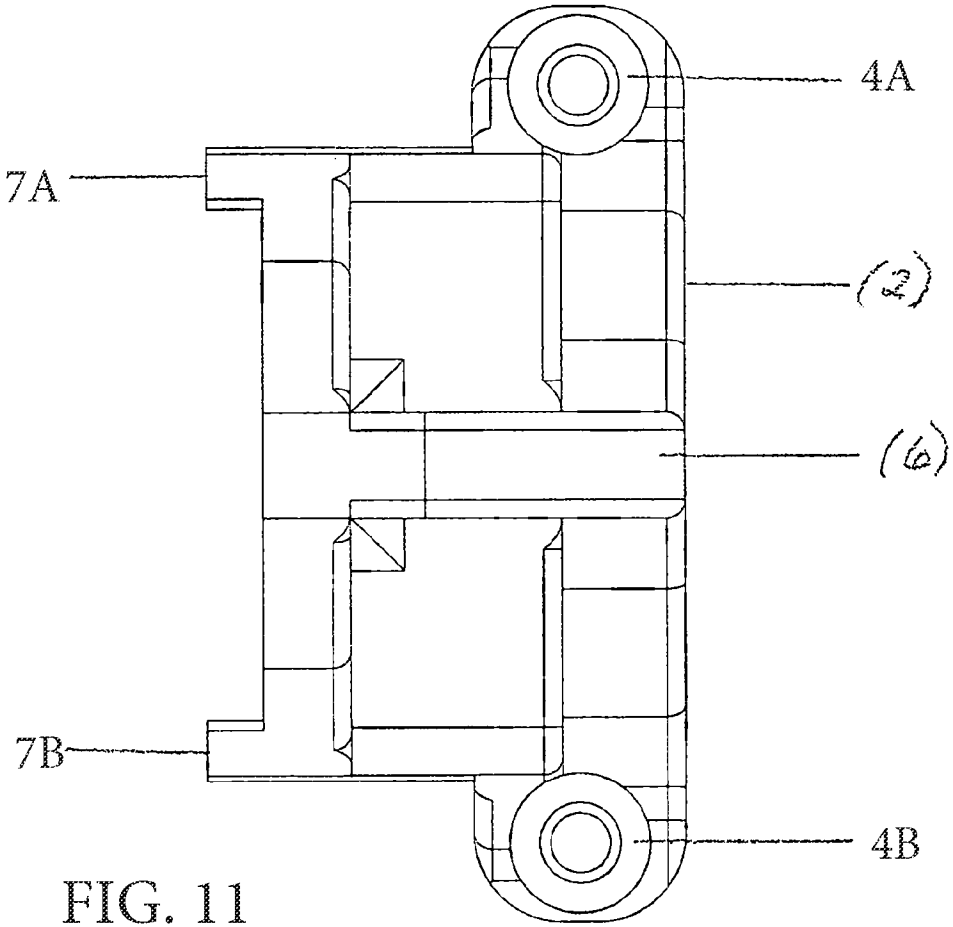
FIG. 11 is a bottom view of the assembled sling mount of FIG. 1.

Referring now to FIGS. 5-11, the sling mount (10) is illustrated in a coupled configuration from a variety of views. As shown in FIGS. 7-11, the sling mount (10) also includes a left side tab (7A) and a right side tab (7B), which may be integrally formed with the base (2), that extend away from the base (2). As shown in FIGS. 10-11, the left side tab (7A) is positioned on a left-most edge of the base (2) and the right side tab (7B) is positioned on a right-most edge of the base (2). The base (2) is secured to the firearm around the bottom portion of the buffer tube (A) such that the tabs (7A, 7B) extend over an outer surface of the receiver end plate (C), as shown in FIG. 1. This is advantageous because then the tabs (7A, 7B) prevent the sling mount (10) from twisting around the buffer tube, as well as from moving horizontally or coming loose during operation of the firearm.

Figure 12:
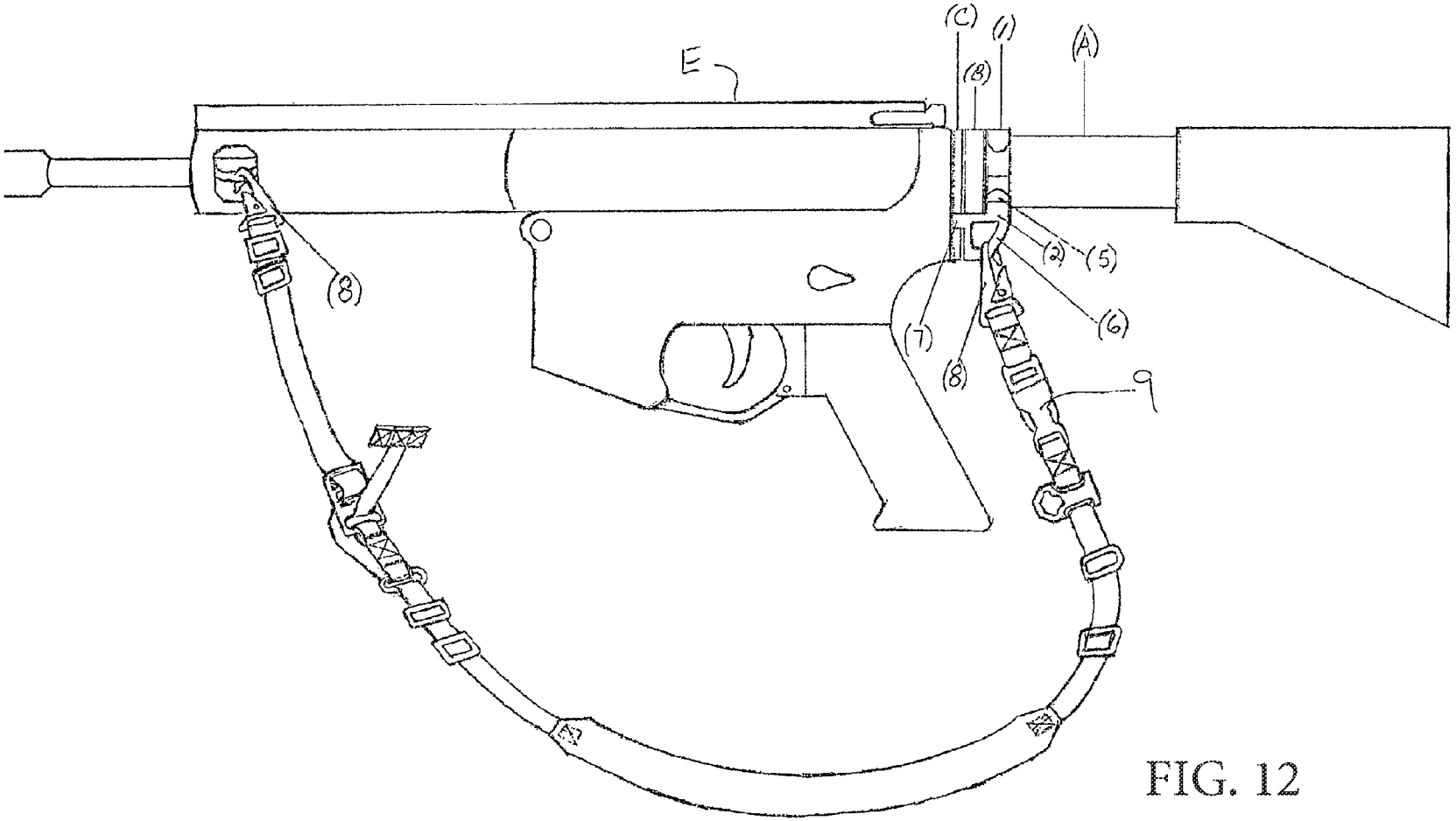
FIG. 12 is a side view of the sling mount of FIG. 1 assembled on a rifle buttstock tube in accordance with the present disclosure, illustrating an attached two-point sling configuration.

As shown in FIG. 12, the sling mount (10) is shown in a coupled state around a buffer tube (10) of a rifle (E), with a sling (9) attached in a two-point configuration. The sling (9) is attached via snaphooks (8) to the connection loop (6) and to a point near the proximal end of the rifle (E). In this configuration, the user places the sling (9) over his or her shoulder. Due to the advantage of the connection loop's (6) position below the buffer tube (A) and behind the castlenut (B) and receiver end plate (C), the user can quickly change the handedness orientation with a decreased chance of the sling (9) catching on gear, while avoiding twisting of the sling (9) and excess noise.

It should be understood that the foregoing is illustrative and not limiting, and that obvious modifications may be made by those skilled in the art without departing from the spirit of the invention. Accordingly, reference should be made primarily to the accompanying claims, rather than the foregoing specification, to determine the scope of the invention.

What is claimed is:

1. A sling mount comprising:

a base member comprising a surface for engaging a buffer tube of a weapon;

a cap member removably coupled to the base member for securing the base member to the buffer tube of the weapon;

wherein a portion of the base member comprises a connection loop for attaching a snaphook, wherein the connection loop and the base member are a single, unitary piece, wherein the connection loop is located on the underside of the base member such that, when the base member is secured to the buffer tube, the connection loop is fixedly positioned under the buffer tube.

2. The sling mount of claim 1, wherein the connection loop extends along a vertical plane substantially parallel to the longitudinal axis of the buffer tube.

3. The sling mount of claim 2, wherein:

the connection loop includes a first end and a second end;

the first end is located on the underside of the base member adjacent the buffer tube; and the second end is located on the underside of the base member adjacent to a receiver end plate of the weapon.

4. The sling mount of claim 1, wherein the connection loop is located at an approximately central position of the underside of the base member.

5. The sling mount of claim 1, wherein the connection loop extends in an arc.

6. The sling mount of claim 1, wherein a plurality of tabs extend longitudinally from the base member, the tabs configured to extend over an outer surface of a receiver end plate of the weapon for preventing movement of the sling mount.

7. The sling mount of claim 1, wherein the cap member further comprises a plurality of threaded bosses oriented in a vertical plane perpendicular to a longitudinal axis of the buffer tube, and wherein the base member further comprises a plurality of recessed bosses oriented in a vertical plane perpendicular to a longitudinal axis of the buffer tube, such that, when the cap member is coupled to the base member, the threaded bosses of the cap member align with the recessed bosses of the base member.

8. The sling mount of claim 7, wherein the cap member is coupled to the base member via screws passed through the recessed bosses into the threaded bosses.

9. The sling mount of claim 8, wherein the screws are about 6⁄32" inches.

10. The sling mount of claim 1, wherein, when the sling mount is coupled to the buffer tube, the cap member is positioned adjacent to a castle nut of the weapon and the base member is positioned adjacent to a receiver end plate of the weapon.

11. The sling mount of claim 1, further comprising a sling removably connected to the connection loop of the base member.

12. The sling mount of claim 11, wherein the sling comprises a snaphook by which the sling is connected to the base member.

13. A weapon comprising a buffer tube and the sling mount of claim 1 coupled to the buffer tube.

14. The weapon of claim 1, wherein the weapon comprises a rifle.

15. The weapon of claim 14, further comprising a sling removably connected to the connection loop of the base member.

16. The sling mount of claim 15, wherein the sling comprises a snaphook by which the sling is connected to the base member.

17. The weapon of claim 1, wherein the weapon comprises a shotgun.

18. The weapon of claim 17, further comprising a sling removably connected to the connection loop of the base member.

19. The sling mount of claim 18, wherein the sling comprises a snaphook by which the sling is connected to the base member.

* * * * *